United States Patent [19]

Taylor

[11] 4,216,685

[45] Aug. 12, 1980

[54] PAIL OPENER

[76] Inventor: John W. Taylor, Reseda, Calif.

[21] Appl. No.: 939,239

[22] Filed: Sep. 5, 1978

[51] Int. Cl.[3] ..... B67B 7/00

[52] U.S. Cl. ..... 81/3.46 A

[58] Field of Search ..... 81/3.46 R, 3.46 A

[56] References Cited

U.S. PATENT DOCUMENTS

| | | | |
|---|---|---|---|
| 1,877,019 | 9/1932 | Nathan | 81/3.46 A X |
| 2,044,129 | 6/1936 | Soukup | 81/3.46 A |
| 3,610,076 | 10/1971 | Martens | 81/3.46 A |

*Primary Examiner*—James G. Smith

*Attorney, Agent, or Firm*—Jack C. Munro

[57] ABSTRACT

A container opener which takes the form of an integral member which has a main straight body section. At one end of the main body section is attached the first extension which depends from the main body section at almost a right angle. The outermost end of the first extension is acutely arcuate so that it substantially bends over on itself with the outermost tip of the extension defining an angle of sixty degrees with respect to the plane of the main body section. A second extension is attached to the main body section and is to be generally curved and ending in a depending flange which is to be connectable with the locking tab type of pail lid.

3 Claims, 6 Drawing Figures

PAIL OPENER

BACKGROUND OF THE INVENTION

At the present time the very common type of pail that is used to contain paints, roofing compound, adhesives and the like is made of a strong plastic material. The lid of this type of pail is also made of plastic and forms an extremely tight fit on the pail. This tight fit is most desirable to prevent the contents from leaking from the pail if the pail is overturned and also to prevent air from entering the pail on resealing.

Although this type of lid has been desiged to facilitate manual removal, the removal of such a lid is extremely difficult for even the strongest individual. As a result, persons attempting to remove such lids frequently grasp some type of tool in an attempt to pry the lid from the container. Frequently grabbed tools are screwdrivers, knives and the like which possibly are not only unsafe from the point of view of possibly causing injury, but also the operation of the tools to effect opening of the lid is not an easy procedure.

There is a definite need for a tool which facilitates the removal of the present day plastic lid which is securely attached to the plastic pail.

SUMMARY OF THE INVENTION

The structure of this invention is believed to be summarily described in the Abstract of the Disclosure and reference is to be had thereto.

The primary object of this invention is to design a tool which facilitates quick and easy removal of a lid which is tightly held upon its container.

A further objective of this invention is to construct an opener which is formed as an integral unit and which can be easily constructed by conventional manufacturing techniques at low cost.

DETAILED DESCRIPTION OF THE SHOWN EMBODIMENT

Figure 1:
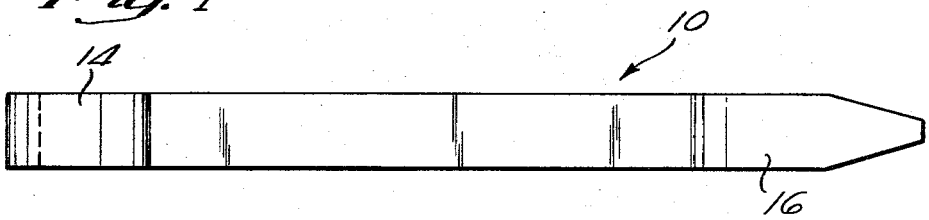
FIG. 1 is a top plan view of the container opener of this invention.

Referring particularly to the drawing there is shown a container opener 10 of this invention which is composed generally of a main body section 12 which has integrally secured at one end an extension 14 and integrally secured to the opposite end there of a second extension 16. The container opener 10 will be constructed entirely of a strapping material and will normally be formed of a metal such as steel or iron.

Figure 2:
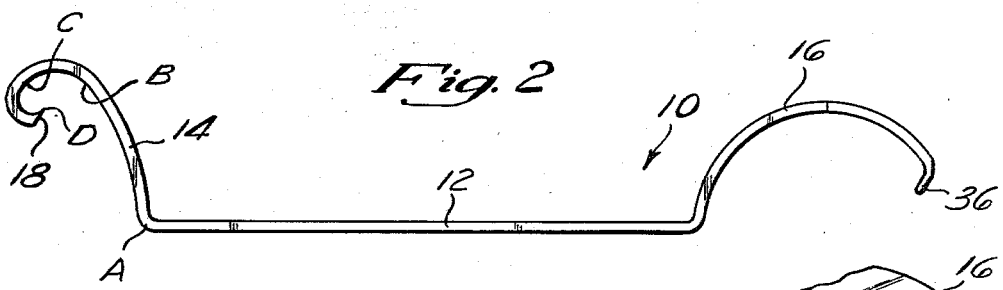
FIG. 2 is a front view of the container opener of this invention.
Figure 3:
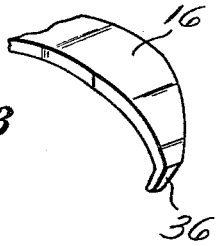
FIG. 3 is a segmental, isometric view of one end of the container opener of this invention.
Figure 4:
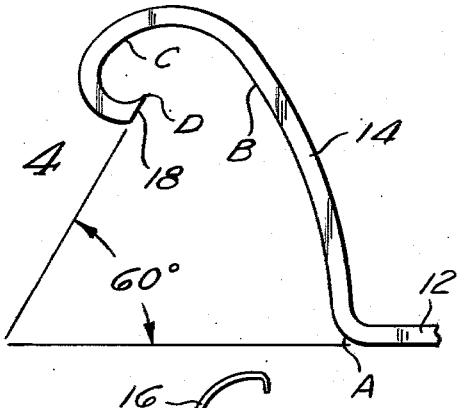
FIG. 4 is a enlarged, segmental, front view of the other end of the container opener of this invention.

The extension 14 is attached to the main body section 12 at almost a right angle as can be seen from FIG. 2 of the drawing. The same holds true for the extension 16.

It is to be noted that the main body section 12 is straight as this is the most preferable configuration.

The portion of the extension 14 adjacent the main body section 12 is slightly curved frompoint A to point B. Point A represents the point of attachment between the extension 14 and the main body section 12. In actual practice the curve of the extension 14 between the points A and B is specifically defined as having a radius of curvature of 3.12 inches with the distance between point A and point B being thirty-eight degrees.

Between point B and point C, the extension 14 moves through an arc of one hundred degrees with the radius of curvature being 0.56 inches. It is to be noted that this portion of the extension is more acutely curved versus the curve from point A to point B.

Between point C and point D the extension 14 is again more acutely curved with the arc being one hundred and eighty degrees and the radius of curvature being 0.18 inches. This results in the extension 14 being almost bent over upon itself. The outermost edge 18 of the tip of the extension 14 is inclined at approximately sixty degrees with respect to the plane of the main body section 12.

Figure 5:
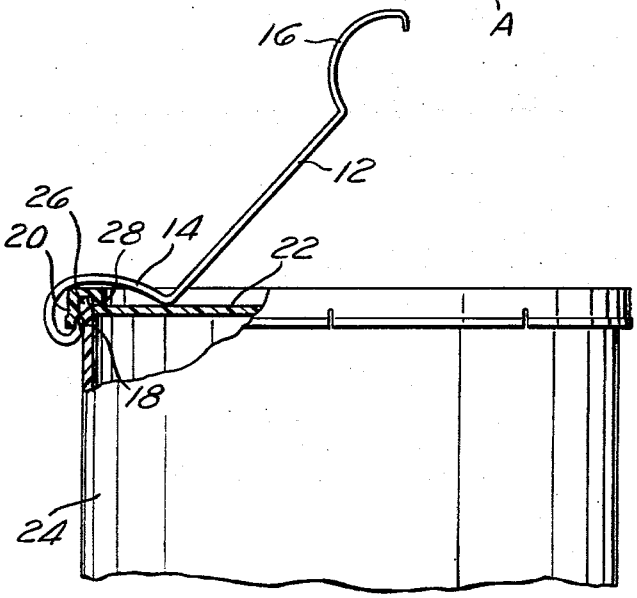
FIG. 5 is a partially, cross-sectioned view of the container opener of this invention showing the use of one end thereof to facilitate opening a particular type of container lid.

This particular construction of the extension 14 is most desirable so that in reference to FIG. 5 the outermost ip of the extension 14 can be readily inserted between the outer flange 20 of a lid 22 and the outer surface of the pail 24. In this position the attachment at point A rests right on the surface of the lid 22. Therefore, by exerting a slight torque on the main body section 12, the outermost tip of the extension 14 pushes up and outwardly against the flange 20 to thereby cause disassociation of the edge 26 of the pail 24 from the annular groove 28 located about the periphery of the lid 22.

This procedure is to be repeated about the periphery of the lid until a sufficient portion of the lid 22 has been removed from the pail 24 in order to effect complete removal of the lid from the pail.

Figure 6:
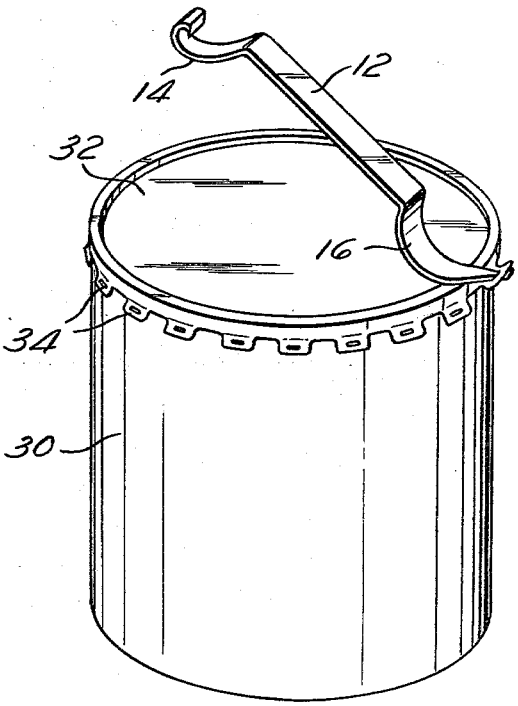
FIG. 6 is an isometric view showing the use of the opposite end of the opener of this invention to remove another type of container lid from a container.

At times there are other types of pails employed such as the pail 30 shown within FIG. 6. The pail 30 is normally constructed of metal and has a metallic lid 32. The peripheral edge of the lid 32 includes a plurality of push down tabs 34. The tabs 34 are to function to facilitate securing of the lid 32 to the pail 30. Each of the tabs 34 include a small opening therein. To facilitate bending back of each of these tabs the second extension 16 may be employed which includes at its outermost edge thereof a depending pointed end 36. The pointed end 36 is to be inserted through a opening in a tab 34 as shown within FIG. 6 and thereby used to bend back the tab. This procedure is to be repeated for the number of tabs that are necessary to effect a removal of the lid 32 from the pail 30.

What is claimed is:

1. In combination with a pail, said pail having an access opening normally closed by a removable lid, the peripheral edge of said lid defining an annular groove, the upper edge of said pail about said access opening being locatable within said annular groove in a tight fitting manner, an opener facilitating the removal of said lid, said opener comprising:

an elongated straight main body section defining a first plane;

an extension depending from said main body section and being integral therewith, the attachment of said extension to said main body section forming approximately a right angle, the portion of said extension nearest said main body section having a slight curvature, the outermost portion of said extension being acutely curved and curved substantially greater than said slight curvature so that the outermost edge of said extension is essentially bent over upon itself, said acute curve being in the same direction as said slight curvature resulting in ever increasing amount of curvature in moving along said extension from said slight curve to said acute curve whereby to remove said lid the said outermost edge is to be partially inserted between said lid and said pail within said annular groove and by placing said area of attachment of said extension and main body section against said lid to thereby function as a fulcrum point in applying torque which causes removal of said lid from said pail.

2. The combination as defined in claim 1 wherein:

said outermost edge of said extension defining approximately an angle of sixty degrees with respect to said first plane.

3. In combination with a pail, said pail having an access opening normally closed by a removable lid, the peripheral edge of said lid including a plurality of spaced-apart push-down tabs, each said tab having a small opening therein, said peripheral edge of said lid also including an annular groove, the upper edge of said pail about said access opening being locatable within said annular groove in a tight fitting manner, an opener facilitating the removal of said lid, said opener comprising:

an elongated straight main body section defining a first plane;

an extension depending from said main body section and being integral therewith, the attachment of said extension to said main body section forming approximately a right angle, said extension being curved, the outermost end of said extension including a depending flange, whereby to remove said lid the said depending flange connects with a said small opening of a said push-down tab with said curved portion of said extension being located against said lid to thereby function as a fulcrum point in applying torque to move upward and outward the said tab and repeating this procedure for a plurality of said tabs permits removal of said lid from said pail.

* * * * *